United States Patent [19]

Cassity

[11] Patent Number: 4,751,965

[45] Date of Patent: Jun. 21, 1988

[54] WELLHEAD SEAL ASSEMBLY

[75] Inventor: Thomas G. Cassity, Katy, Tex.

[73] Assignee: Cameron Iron Works USA, Inc., Houston, Tex.

[21] Appl. No.: 44,413

[22] Filed: Apr. 30, 1987

[51] Int. Cl.[4] ..... E21B 33/043

[52] U.S. Cl. ..... 166/182; 166/196; 166/208; 166/348; 277/117; 277/125; 277/236; 285/139; 285/352; 285/382.5

[58] Field of Search ..... 166/348, 85, 206, 208, 166/217, 182, 195, 196; 285/382, 382.4, 382.5, 329, 351, 352, 139; 277/236, 116, 116.6, 116.8, 117, 118, 123–125, 205, 206 A

[56] References Cited

U.S. PATENT DOCUMENTS

| | | | |
|---|---|---|---|
| 3,282,346 | 11/1966 | Claycomb | 277/116.6 X |
| 4,131,287 | 12/1978 | Gunderson et al. | 277/236 X |
| 4,353,560 | 10/1982 | Tohill | 277/117 X |
| 4,384,726 | 5/1983 | Meyer | 277/117 X |
| 4,411,435 | 10/1983 | McStravick | 277/117 X |
| 4,561,499 | 12/1985 | Berner, Jr. et al. | 166/85 |
| 4,646,845 | 3/1987 | Boeker | 166/88 X |
| 4,665,979 | 5/1987 | Boehm, Jr. | 166/208 |

*Primary Examiner*—Stephen J. Novosad
*Assistant Examiner*—Hoang C. Dang
*Attorney, Agent, or Firm*—Vinson & Elkins

[57] ABSTRACT

The improved wellhead seal assembly includes an annular metal seal ring having upper spaced apart inner and outer rims with an upper energizing ring positioned between such rims and movable axially between them, a resilient seal embedded in and extending through ports in the central portion of the seal ring, lower inner and outer seal rings connected to said central portion of said seal ring by inner and outer bellows and a wedging ring depending from the central portion of the seal ring between such bellows and adapted to move downward between the inner and outer seal rings to wedge them apart into sealing engagement with the inner and outer sealing surfaces, such movement being responsive to downward movement of the upper energizing ring and the flexing of the lower bellows legs and continued movement of said upper energizing ring wedging said upper rims apart into sealing engagement with the inner and outer sealing surfaces, the upper energizing ring being releasably connected to the upper seal rims so that said upper seal is not set until the lower seal is completely energized and set.

15 Claims, 3 Drawing Sheets

WELLHEAD SEAL ASSEMBLY

BACKGROUND

The present invention relates to an improved annular seal assembly to be utilized for sealing across the annulus between the interior of a wellhead housing and the exterior of a hanger positioned within the wellhead housing.

Prior wellhead annular seals have included resilient seals which are actuated into sealing position by axial force exerted on the seal ring. (U.S. Pat. No. 2,920,909)

Other wellhead seals have included resilient material with metal end members having lips which when the seal is set engage the sealing surfaces to prevent extrusion of the resilient material as shown in U.S. Pat. No. 3,797,864.

Other annular wellhead seals have wedging elements to wedge the seal legs into sealing engagement with its sealing surfaces after the seal has been properly positioned with respect to such sealing surfaces. This structure is shown in U.S. Pat. Nos. 4,131,287 and 4,595,053. This latter patent also discloses the use of wickers or small parallel grooves into which the seal is forced for sealing.

SUMMARY

The improved wellhead seal assembly includes an annular metal seal ring having upper spaced apart inner and outer legs with a wedge positioned between such legs and movable axially between them, a resilient seal embedded in and extending through ports in the central portion of the seal ring, lower inner and outer bellows type legs which are spaced apart and attach above a lower metal ring and a wedging ring depending from the central portion of the seal ring between such bellows legs and lower metal seal and adapted to move downward between the bellows legs and the lower metal seal to wedge them apart into sealing engagement with the inner and outer sealing surfaces, such movement being responsive to downward movement of the central portion of the seal ring and the flexing of the lower bellows legs.

An object of the present invention is to provide an improved annular seal assembly for sealing in the annulus between wellhead members which ensures both metal-to-metal seals and resilient seals.

Another object is to provide an improved annular wellhead seal assembly providing independent upper, inner and outer seals, lower inner and outer seals and intermediate resilient seal.

Still another object is to provide an improved annular wellhead seal having redundant metal-to-metal seals.

Still another object is to provide an improved annular wellhead seal which eliminates relative motion between the seal and either of the interior of the well-head housing and the exterior of the hanger during the setting process and thus avoids the detrimental effect on both the seal assembly and the members against which it is to seal which is caused by such relative motion.

BRIEF DESCRIPTION OF THE DRAWINGS

These and other object and advantages of the present invention are hereinafter set forth and explained with reference to the drawings wherein.

DESCRIPTION OF THE PREFERRED EMBODIMENTS

Figure 1:
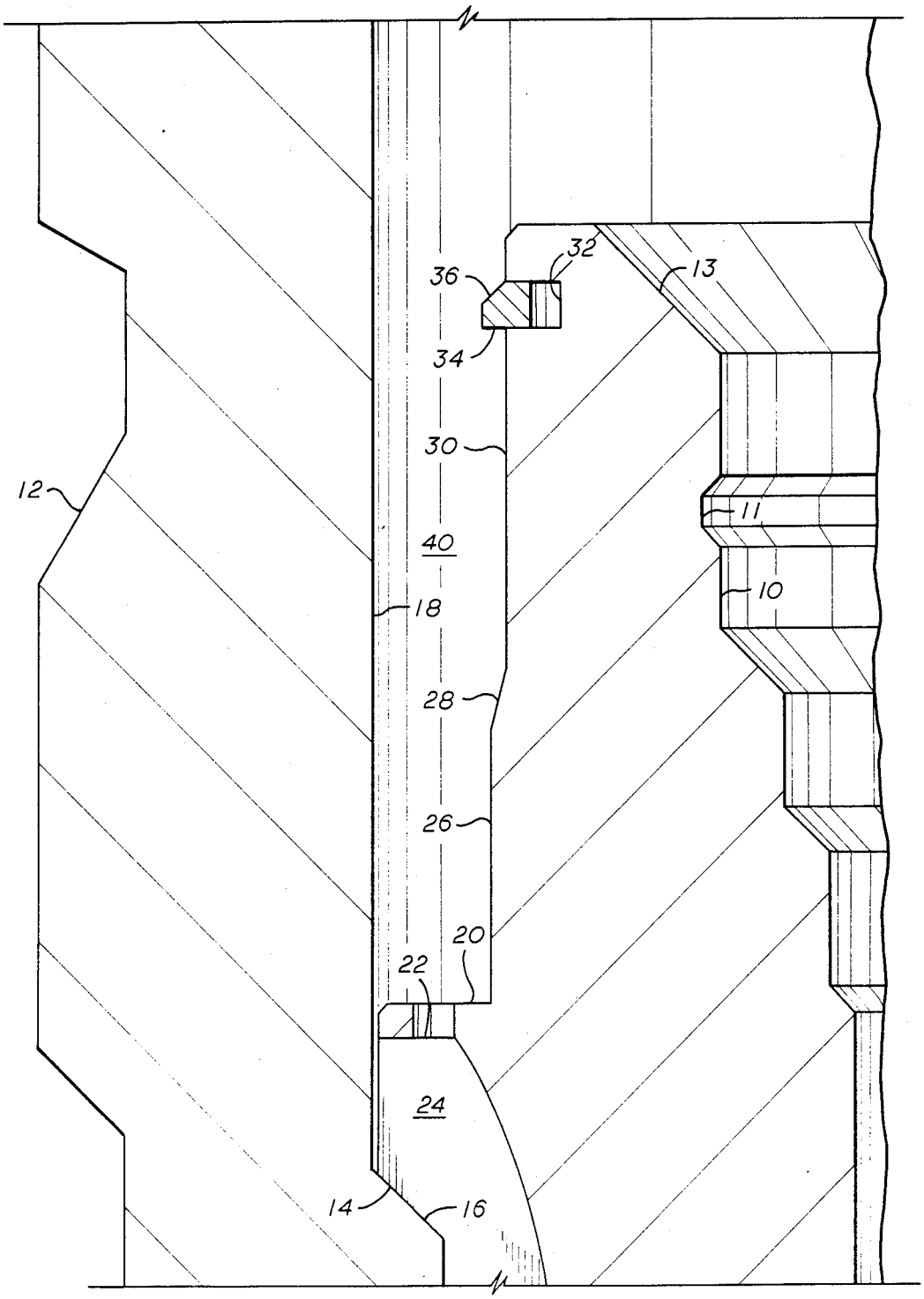
FIG. 1 is a sectional view of a wellhead with the hanger landed on the housing seat.
Figure 2:
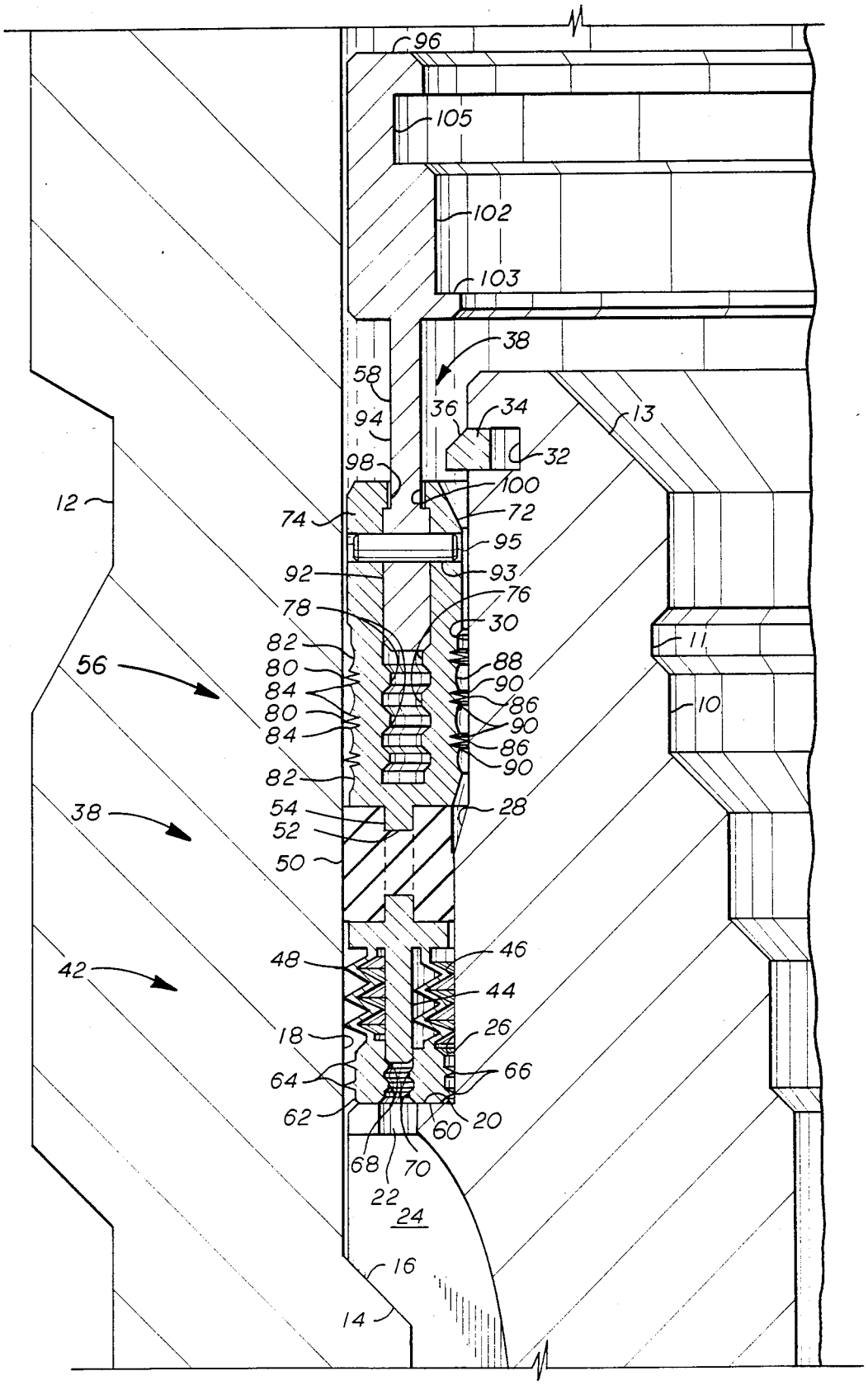
FIG. 2 is a sectional view of the improved wellhead seal assembly landed in the annulus between the hanger and the housing.
Figure 3:
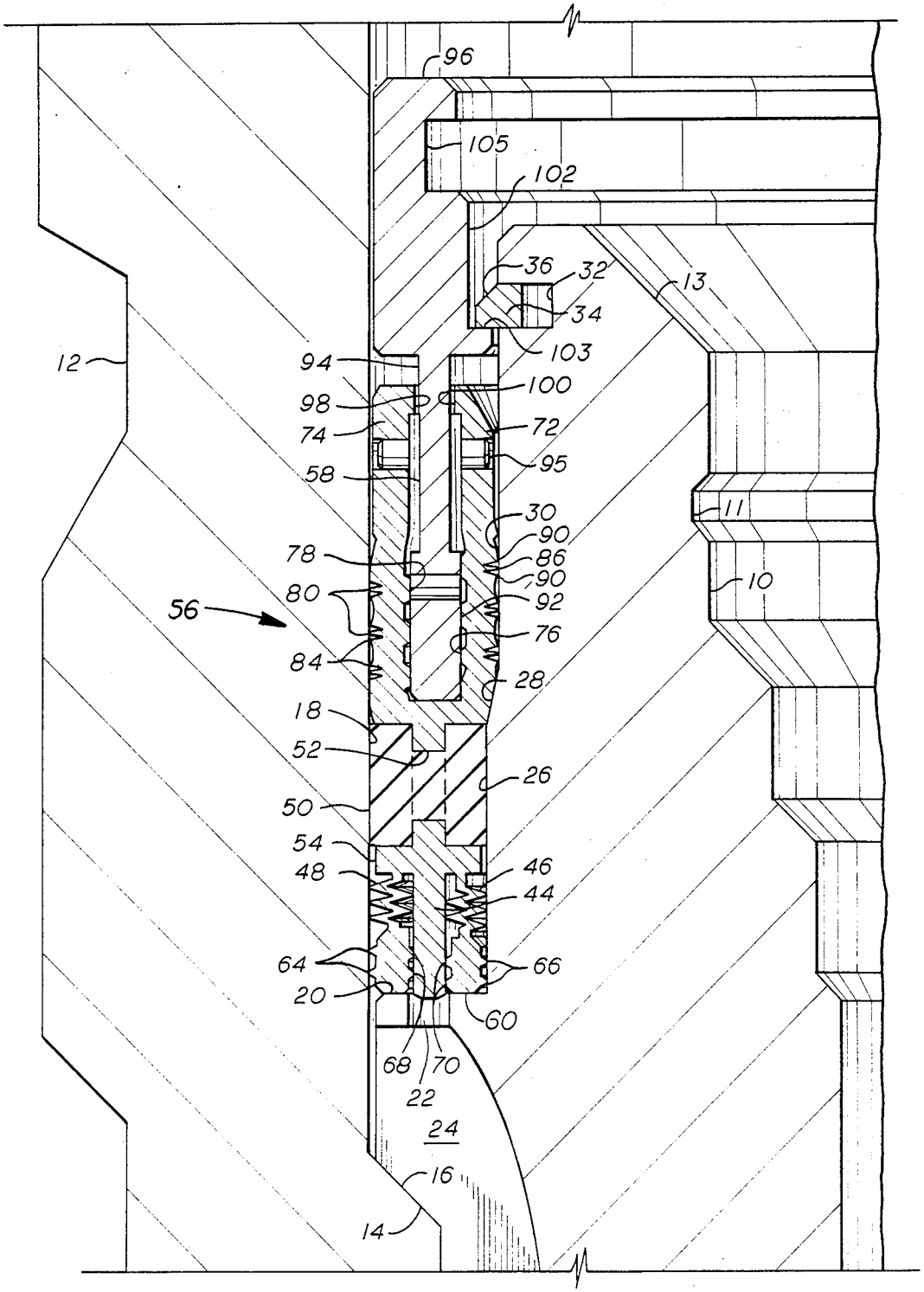
FIG. 3 is a sectional view of the improved wellhead seal assembly moved into sealing engagement with the housing and the hanger.

As shown in FIG. 1, hanger 10 has been landed within wellhead housing 12 with lower landing shoulder 14 in engagement with landing seat 16 on the interior of housing 12. The interior of housing 12 above landing seat 16 is a smooth bore and provides sealing surface 18 for sealing engagement by the improved seal assembly of the present invention as hereinafter described. Upwardly facing shoulder 20 on hanger 10 is positioned above landing shoulder 14 and includes groove 22 in its mid portion as shown. The usual mud slot 24 is provided for the circulation of fluids prior to the landing of the seal assembly on shoulder 20. The exterior of hanger 10 above shoulder 20 is substantially cylindrical and provides lower sealing surface 26. Tapered surface 28 extends upwardly and inwardly from lower sealing surface 26 to upper sealing surface 30 which is slightly smaller than surface 26. Groove 32 is positioned in the upper exterior of hanger 10 and split latch ring 34 is positioned therein. Latch ring has its outer upper surface 36 tapered to allow seal assembly 38 (as shown in FIGS. 2 and 3) to pass thereby into its position in annular space 40 between sealing surface 18 on housing 12 and sealing surfaces 26 and 30 on hanger 10. Hanger 10 includes preparation 11 for accepting a suitable handling tool to facilitate running into and out of housing 12. Hanger 10 also includes upwardly facing landing seat 13 for accepting and supporting any additional hangers that may be installed at a later date.

Normally, it is preferred tht both hanger 10 and seal assembly 38 be run into the wellhead at the same time on a suitable tool. This eliminates an extra trip. Seal assembly 38 would be held by the running tool (not shown) at a position above hanger 10 so that it would not interfere with the circulation of fluids through the annular space 40. When sealing across annular space 40 is desired, seal assembly 38 is lowered into annular space 40 to the position shown in FIG. 2. As can be seen, seal assembly 38 has passed latch ring 34 and has its lower end seated on shoulder 20.

Seal assembly 38 includes lower seal 42 with internal seal energizing ring 44 supported above lower seal 42 by inner and outer bellows 46 and 48, intermediate resilient seal 50 which is positioned through openings 52 through seal body 54, upper seal 56, and upper seal energizing ring 58.

Lower seal 42 includes inner seal ring 60 and outer seal ring 62. Sealing ribs 64 extend around the exterior of outer seal ring 62 and sealing ribs 66 extend around the interior of inner seal ring 60. It should be noted that sealing ribs 64 and 66 are at different levels above the shoulder 20 when seal assembly 38 is seated thereon. Lower seal energizing ring 44 extends downward from seal body 54 and in its unset position projects between inner and outer seal rings 60 and 62 and between inner and outer bellows 46 and 48. Lands 68 extend inward on the inner surface of outer seal ring 62 and lands 70 extend outward on the outer surface of inner seal ring 60. As best seen in FIG. 2, lands 68 and 70 are at different levels so that lands 68 are initially engaged by downward movement of seal energizing ring 44 to urge outer seal 62 into sealing engagement with sealing surface 18 and with its ribs 64 in penetrating engagement therewith to provide a positive metal-to-metal seal. The subsequent engagement of lands 70 on inner seal ring 60 by further downward movement of seal energizing ring 44 urges inner seal ring 60 into sealing engagement with hanger sealing surface 26 and with its ribs 66 in penetrating engagement therewith to provide a positive metal-to-metal seal. This alternate engagement of seal energizing ring 44 first with lands 68 and then with lands 70 tends to minimize the force required to move outer seal 62 and inner seal 60 into sealing engagement with their respective bores. It is preferable that lands 68 be at the same level as outer ribs 64 and that lands 70 be at the same level as inner ribs 66 so that direct radial loading occurs on the ribs 64 and 66 to further minimize the forces required to cause penetration by the ribs into the housing sealing surface 18 and the hanger sealing surface 26.

Upper seal 56 includes inner rim 72 extending upward from the inner portion of seal body 54 and outer rim 74 extending upward from the outer portion of seal body 54. Rims 72 and 74 are spaced apart and the lower portion of energizing ring 58 is positioned between the upper portions of rims 72 and 74 in engagement with the upper of external lands 76 on the exterior of inner rim 72. Rim 74 includes internal lands 78 which are alternately spaced above seal body 54 with respect to lands 76 on rim 72 as best seen in FIG. 2. Sealing ribs 80 on the exterior of outer rim 74 are provided with concave recesses 82 on each side of each rib 80 and also immediately above and below each of ribs 80 pointed depression 84. Sealing ribs 86 on the interior of inner rim 72 are similar in structure to ribs 80 and include the concave recesses 88 on each side of each rib and immediately above and below each of ribs 86 pointed depression 90. It should also be noted that sealing ribs 80 are positioned at the same level as lands 78 and sealing ribs 86 are also positioned at the same level as lands 76. Such positioning ensures that the wedging action of energizing ring 58 is exerted directly on sealing ribs 80 and 86 to cause them to dig into their respective sealing surfaces 18 and 30 providing the desired positive metal-to-metal seal. Upper energizing ring 58 includes lower wedge portion 92, shank 94 and head 96. Shank 94 is smaller than wedge portion 92 and inner flange 98 on the upper end of outer rim 74 and outer flange 100 on the upper end of inner rim 72 provide an opening through which shank 94 extends with shank 94 being smaller than the radial dimension of wedge portion 92. Wedge portion 92 is attached to inner rim 72 and outer rim 74 by shear pins 93 positioned in bores 95 which pass through ring 74, wedge portion 92 and rim 72. Shear pins 93 are sized such that they do not shear until seal assembly 38 is landed on shoulder 20 and lower seal 42 is fully energized and set. In this manner premature energization or setting of upper seal 56 does not interfere with setting of lower seal 42.

Head 96 of upper energizing ring 58 includes recessed internal diameter 102 with upward facing shoulder 103 which engages latch ring 34 after seal assembly 38 has been set and energized. Head 96 also includes internal groove 105 to accept a running tool (not shown) that is used to release latch ring 34 and retrieve seal assembly 38 or to install seal assembly 38 into annular space 40.

With seal assembly 38 in the position shown in FIG. 2, the setting proceeds by the a downward force exerted on the upper end of seal energizing ring 58. This moves energizing ring 58 downward but due to shear pins 93, upper seal 56 and seal body 54 also move downward so that lower seal 42 is set. The setting of lower seal 42 is accomplished by the downward movement of body 54 which compresses inner and outer bellows 46 and 48 to allow seal energizing ring 44 to move downward within lower seal 43 and wedge inner seal ring 60 inwardly into sealing engagement with sealing surface 26 and outer seal ring 62 outwardly into sealing engagement with sealing surface 18. The downward movement of energizing ring 44 continues and after passing through seal rings 60 and 62 into the groove 22 in shoulder 20 so that contact with shoulder 20 does not interfere with the setting of lower seal 42. The extent of the downward movement of upper seal 56 is limited by the engagement of the lower inner surface of inner rim 72 with tapered surface 28. Thereafter, further continued movement of upper energizing ring 58 shears pins 93 and ring 58 moves downward within inner and outer rims 72 and 74 wedging them outward so that their sealing ribs 86 and 80 are forced into tight metal-to-metal sealing engagement with surfaces 30 and 18, respectively. This set position is clearly shown in FIG. 3. In the fully set position, upwardly facing shoulder 103 in the upper end of energizing ring 58 has moved downward so that it is at the same level as groove 32 and in doing so, it passes latch ring 34 until shoulder 103 and groove 32 are aligned and then latch ring 34 moves outward so that it latches seal assembly 38 in its set position.

What is claimed is:

1. A wellhead seal assembly adapted to be positioned for sealing within an annular recess between two tubular members in a well bore comprising an annular metal seal body having openings in its intermediate portion, an upper metal seal, and a lower metal seal, an upper seal energizing ring positioned above said upper seal for downward movement with respect thereto to set such upper seal, said lower seal including spaced apart inner seal ring and outer seal ring and resilient means connecting said inner and outer seal rings to said seal body, and a lower energizing ring depending from said body and extending downwardly to a point between the upper ends of said inner and outer seal rings, the downward setting movement of said upper seal energizing ring moving said upper seal and said body downward to move said lower energizing ring between said inner and outer seal rings to urge them radially apart into sealing engagement with the walls of the tubular members forming the annular recess in which said assembly is positioned of said tubular members.

2. A wellhead seal assembly according to claim 1 wherein said seal rings of said lower seal each include sealing ribs having pointed outer surfaces to dig into the surfaces of said tubular members surrounding said seal assembly.

3. A wellhead seal assembly according to claim 1 including a resilient sealing element embedded within and through said openings in the intermediate portion of said body.

4. A wellhead seal assembly according to claim 1 wherein said resilient connecting means includes an inner annular bellows connecting from said body to said inner seal ring, and an outer annular bellows connecting from said body to said outer seal ring.

5. A wellhead seal assembly according to claim 1 wherein said seal body includes an inner portion and an outer portion, said upper seal includes an inner seal rim extending upward from the inner portion of said body, and an outer seal rim extending upward from the outer portion of said body and being spaced radially outward from said inner seal rim, said upper seal energizing ring being positioned initially between the upper ends of said seal rims and upon downward setting movement subsequent to the setting of the lower seal moves downward between the upper ends of said seal rims to force them radially apart into sealing engagement with the walls of the tubular members surrounding the seal assembly.

6. A wellhead seal assembly according to claim 1 wherein said upper seal includes upstanding, spaced apart inner and outer sealing rims, a plurality of sealing ribs on the exterior of said outer sealing rim and on the interior of said inner sealing rim, and a plurality of lands on the interior of said outer sealing rim and on the exterior of said inner sealing rim.

7. A wellhead seal assembly according to claim 6 wherein said sealing ribs on the exterior of said outer sealing rim are at different levels than the sealing ribs on the interior of the inner sealing rim.

8. A wellhead seal assembly according to claim 7 wherein the lands of said outer sealing rim being on the same level as the sealing ribs on said outer sealing rim, and the lands of said inner sealing rim being on the same level as the sealing ribs on said inner sealing rim.

9. A wellhead seal assembly according to claim 2 including lands on the interior of said outer seal ring, and lands on the exterior of said inner seal ring, said lands on each ring being at the same level as the sealing ribs on the same ring so that the force of the lower energizing ring is directly behind the sealing ribs to ensure positive force on the sealing ribs for digging engagement into the walls against which they are sealing.

10. A wellhead seal assembly according to claim 5 including means for limiting the downward movement of said body so that further movement of said upper energizing ring moves between said seal rims to urge them apart to sealing position.

11. A wellhead seal assembly according to claim 5 including means preventing relative movement of said upper seal energizing ring with respect to said inner and outer seal rims.

12. A wellhead seal assembly according to claim 11 wherein said movement prevention means includes at least one shear pin engaging said upper seal energizing ring and said inner and outer seal rims.

13. A hanger and seal for installation in a wellhead housing comprising a hanger body having a landing shoulder for landing within a wellhead housing and a second upwardly facing shoulder above said landing shoulder with a cylindrical sealing surface above said second shoulder coacting with the interior of said wellhead housing to form an annulus to be sealed, and a seal assembly including a metal seal body, and upper metal seal, a lower metal seal and an upper energizing ring, said seal assembly adapted to be landed on said second hanger shoulder in surrounding relationship to said cylindrical sealing surface, said lower metal seal including an inner metal seal ring, an outer metal seal ring spaced outwardly from said inner metal seal ring, resilient means connecting said inner and outer metal seal rings to said metal seal body and a lower energizing ring depending from said metal seal body and extending downwardly to a point within the upper ends of the inner and outer metal seal rings, downward movement of said upper energizing ring moving said metal seal body and its depending lower energizing downward within said inner and outer metal seal rings for setting said lower seal into sealing engagement with said hanger sealing surface and the interior of the wellhead housing in which said hanger is landed and subsequent downward movement of said upper energizing ring setting said upper seal in a similar sealing engagement between the hanger and the wellhead housing.

14. An apparatus according to claim 13 including means for preventing initial downward movement of said upper energizing ring from setting said upper seal.

15. An apparatus according to claim 14 wherein said movement prevention means includes at least one shear pin connecting said energizing ring to said upper seal and having sufficient strength to resist shearing prior to the completion of energizing of said lower seal.

* * * * *